United States Patent [19]

Cattini

[11] Patent Number: 4,836,524

[45] Date of Patent: Jun. 6, 1989

[54] CARRIAGE WITH TURRET SUPPORT FOR BOLTS OF FABRIC FOR SPREADING ON THE BEDPLATE OF AUTOMATIC SPREADERS

[75] Inventor: Flavio Cattini, Bergamo, Italy

[73] Assignee: FK Arna S.R.l., Bergamo, Italy

[21] Appl. No.: 90,329

[22] Filed: Aug. 28, 1987

[30] Foreign Application Priority Data

Nov. 4, 1986 [IT] Italy ..... 5232 A/86

[51] Int. Cl.[4] ..... B65H 29/46

[52] U.S. Cl. ..... 270/31; 242/62

[58] Field of Search ..... 270/30–31; 83/925 CC; 242/55, 55.01, 55.1, 56 R, 56 A, 62

[56] References Cited

U.S. PATENT DOCUMENTS 2,980,421 4/1961 Deichmann ..... 270/31

4,708,331 11/1987 Etcheparre et al. ..... 270/31

FOREIGN PATENT DOCUMENTS 598825 3/1978 U.S.S.R. ..... 270/31

*Primary Examiner*—Eugene H. Eickholt

*Attorney, Agent, or Firm*—McGlew and Tuttle

[57] ABSTRACT

An automatic fabric-spreading carriage is disclosed, in which the turret support for the bolt of fabric is improved in such a way that return rollers for the fabric and operations of unthreading and rethreading are obviated. The turret support is rotatingly mounted on a foot step basing that has a diametral opening for the fabric perpendicularly beneath the bolt, so that the fabric passes through the foot step basing itself.

3 Claims, 2 Drawing Sheets

CARRIAGE WITH TURRET SUPPORT FOR BOLTS OF FABRIC FOR SPREADING ON THE BEDPLATE OF AUTOMATIC SPREADERS

FIELD OF THE INVENTION

The present invention relates to a carriage with a turret support for bolts of fabric to be spread on the bedplate of automatic spreaders and, more particularly, to a carriage with a unique turret support which is rotatably mounted on a foot step basing.

BACKGROUND OF THE INVENTION

Automatic spreaders for bolts of fabric comprise, generally, a bedplate and a carriage equipped with means for carrying, spreading and cutting the fabric on the bedplate, in correspondence with the number of sections of the garment to be manufactured.

In the known arrangements, the spreading carriage has generally a bridge structure and stands or is movable to stand above the bedplate, so as to permit the production of a plurality of stacked layers of fabric as a result of the displacements of the carriage on the bedplate. The fabric then, generally in bolts, is loaded on a supporting means provided on the spreading carriage and is led onto the surface of the bedplate by guiding rollers provided on the carriage and with the assistance of gripping means for at least the edges of the fabric to be spread.

The structure of an automatic fabric spreader is already by itself considerably complex and it becomes even more so, if and when the bolt of fabric has to be rotated 180 degrees above the carriage. The carriage, in this case, has to be provided with a turret or castle-like support for the bolt capable of rotating about a vertical axis, in order to rotate the fabric and spread it also with surfaces opposite each other during the displacements of the carriage. The rotation of the castle or turret support is effected on a foot step basing, the presence of which requires in practice the need for deviating the routing of the fabric, as it leaves the bolt, beyond the foot step basing itself and, therefore, outside of the vertical plane passing through the axis of the bolt. Such an arrangement is quite undesirable, because it requires the presence of return rollers and laborious other operations of unthreading and rethreading of the fabric between the rollers each time the turret is being rotated.

DESCRIPTION OF THE INVENTION

The present invention affords a solution of the heretofore existing problems mentioned hereinabove and provides for the overcoming of the disadvantages of the prior art devices. The present invention provides for a carriage with a turret support for the fabric to be spread on the bedplate of automatic spreaders, which carriage is so structured as to permit the passage of the fabric through the foot step basing of the turret itself perpendicularly to the bolt of fabric. The fabric, during the spreading operation, does not suffer deviations and comes to rest on the bedplate substantially in a direction perpendicular to the bolt axis, regardless of the dimension of the bolt and of the direction of unrollment of the fabric. Such an arrangement, furthermore, allows, if necessary, the elimination of the traditional guiding rollers of the fabric toward the bedplate and the simplification of the threading operations of the fabric after each rotation of the turret support, because the head or edge of the fabric falls automatically toward the opening provided therefor and needs, thus, to be simply fed to the opening.

It is therefore the object of the present invention to provide a carriage with rotating turret support for fabric spreaders, as claimed in claim 1 hereinafter.

THE DRAWINGS

An embodiment of practical realization of the present invention will be described more fully hereinbelow with reference to the accompanying drawings, in which.

DETAILED DESCRIPTION OF THE INVENTION

Figure 1:
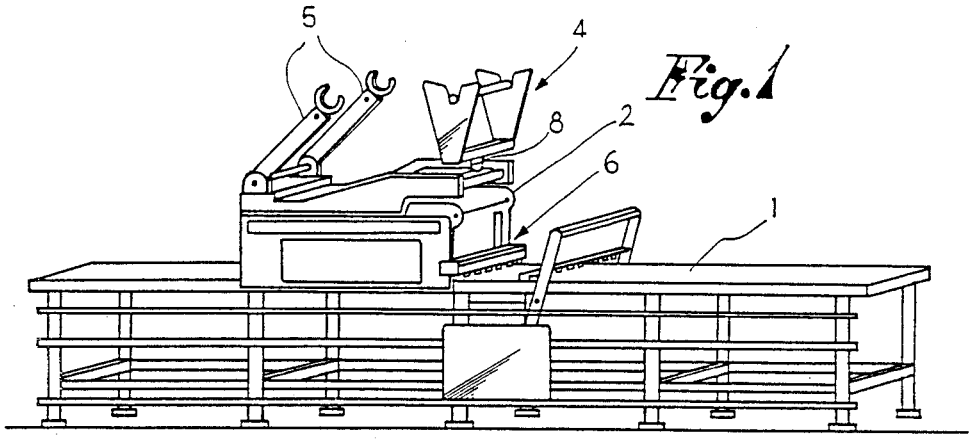
FIG. 1 is a schematic view of a fabric spreader.

With reference to the accompaning drawings, on the bedplate 1 of an automatic fabric spreader is mounted and is alternately sliding in a manner known per se a carriage 2 for the spreading of the fabric which is normally unfolded from bolt 3. Carriage 2—see FIG. 1—carries a turret support 4 for the heavy bolt 3 of fabric to be spread. Also carried by the carriage are means 5 for loading the fabric onto the turret 4, at least one cutter 6 for the transverse cutting of the fabric on the bedplate 1, and other optional and complementary accessories. The turret support 4 is capable of rotations of at least 180 degrees about a vertical axis X, so as to invert the spreading direction of the fabric; however, in any event during the spreading operation, the turret support 4 and the bolt 3 are oriented transversely with respect to the bedplate 1, that is with respect to the direction of displacement of the carriage 2.

Figure 2:
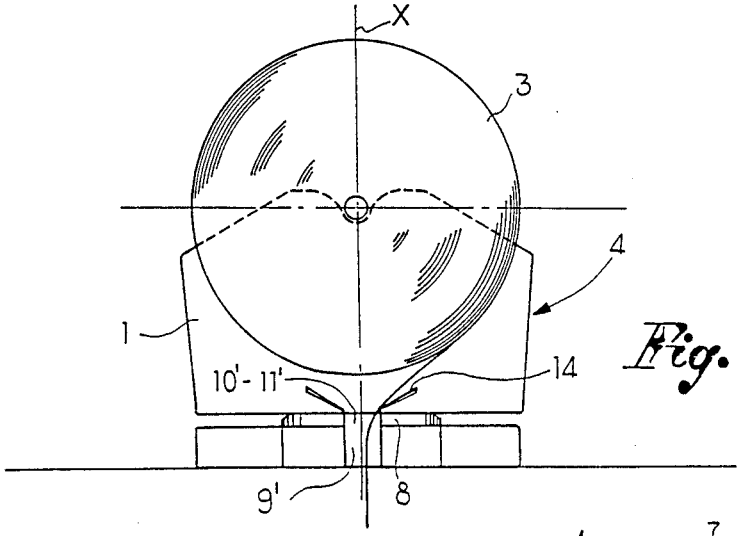
FIG. 2 is a schematic side view of the individual turret support.
Figure 3:
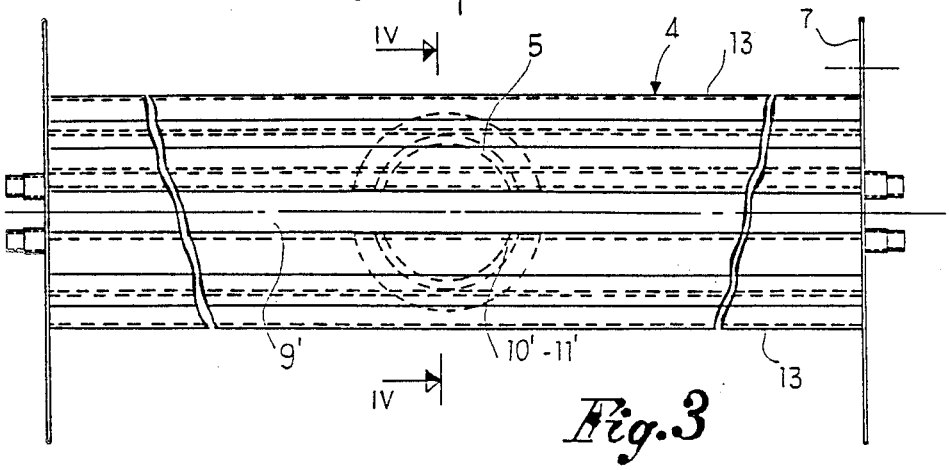
FIG. 3 is a front elevational view of the turret support.

More precisely, the turret support 4 consists of—see FIGS. 2 and 3—a U-shaped framing 7 that supports a bolt of fabric 3 and rests, by means of a foot step basing 8, on a pair of horizontal cross members 9 spaced parallel to each other and fixedly attached to the carriage 2. The two cross members 9 define therebetween an opening or vertical passage 9' which results approximately perpendicularly beneath the bolt 3 and is oriented, similarly to bolt 3, transversely with respect to the bedplate 1 and, therefore, with respect to the direction of displacement of the carriage 2.

The foot step basing 8 consists of a fixed annular element 10 integral with the cross members 9, and a rotating annular element 11 attached to the frame 7. The two annular elements 10 and 11 are complementary to each other and are coupled together, preferably by interposed rolling means 12, such as rollers or ball bearings.

Figure 4:
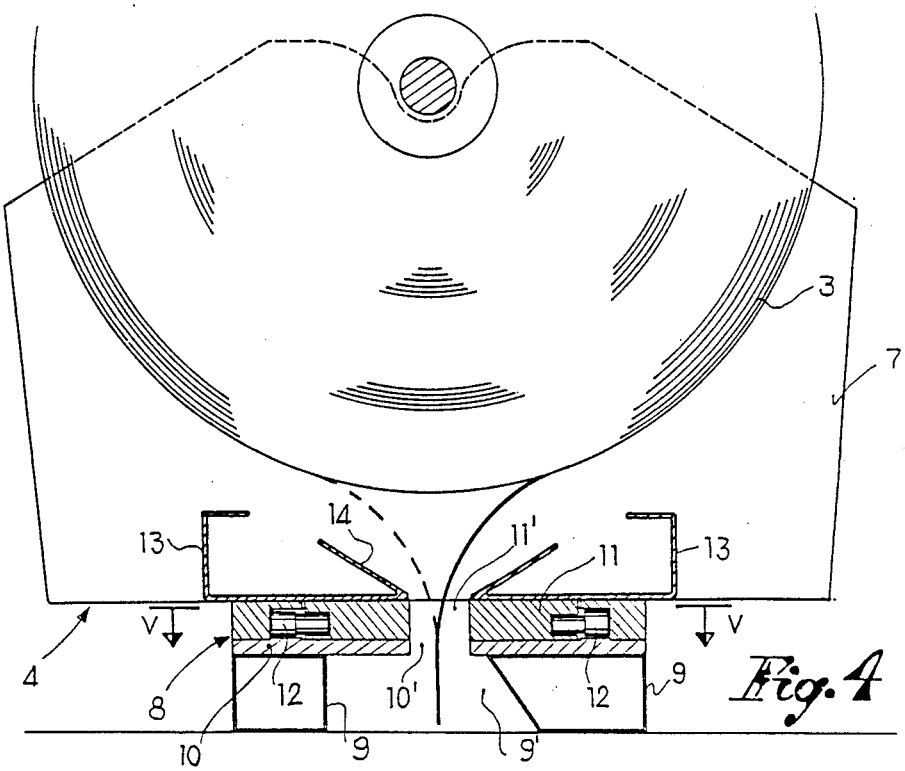
FIG. 4 is a sectional view taken along lines IV—IV of FIG. 3.
Figure 5:
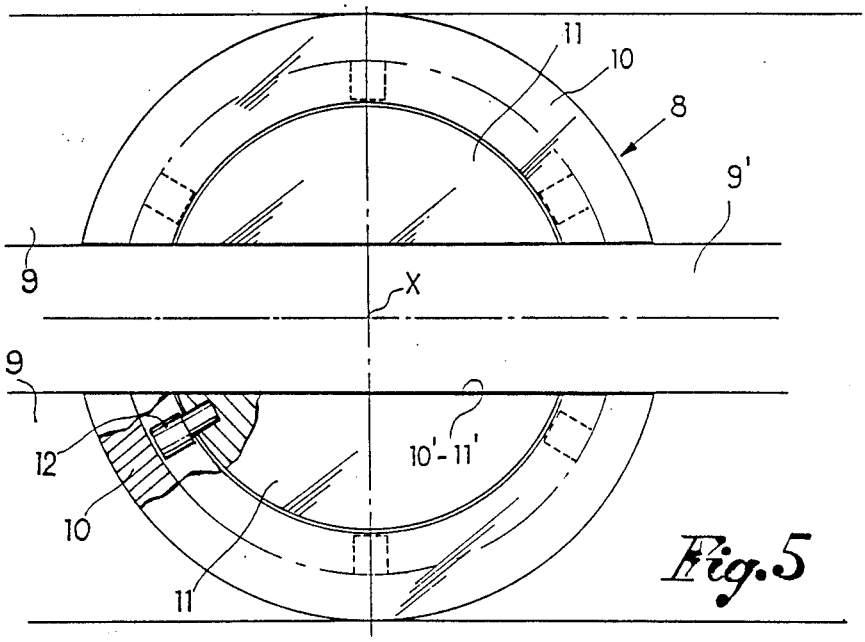
FIG. 5 is an enlarged elevational view of the foot step basing taken along lines V—V of FIG. 4.

The coupling of the two elements, thusly, allows the rotation of the framing 7 on the carriage 2, when a manual or mechanical rotational force is applied. Each of the two elements 10 and 11 of the foot step basing 8 is provided with a diametral opening (10' and 11', respectively) which divides the element substantially into two parts. The diametral opening 10' of the fixed annular element 10 coincides permanently with the opening or passage 9', defined by the two cross members 9, while the diametral opening 11' of the annular element 11 (which rotates with the framing 7) changes orientation with the rotation of the framing 7, obstructing and, respectively, freeing the opening 10' of the fixed element 10. However, when the framing 7 is ready for the spreading of the fabric—see FIGS. 4 and 5—, that is in the position wherein the axis of bolt 3 is oriented transversely with respect to the direction of displacement of the spreading carriage 2, the two diametral openings 10' and 11' of the elements 10–11 are superimposed and coincident to each other and also to the opening 9', In this manner, the fabric that unfolds from the bolt 3 may pass freely through these mutually coinciding openings 10'–11' and may come to rest on the bedplate through opening 9'.

In practice, the fabric passes then through the elements of the foot step basing 8, perpendicularly and beneath the bolt 3, eliminating the need of having to lead it outside of the foot step basing 8. Obviated also are the traditional return rollers, even though corresponding to the passage of the fabric through the foot step basing there might be provided some rollers—not shown—for keeping the fabric well spread during its unfolding from the bolt.

For correctly guiding the fabric perpendicularly beneath the bolt 3 and for facilitating its insertion in the mutually coinciding openings 11'–10'–9', a pair of cross members 13 may be attached to the framing 7, above the foor step basing 8, one cross member spaced parallel from the other and defining therebetween an inviting flared opening 14, as represented in the drawings.

As stated hereabove, the rotation of the framing 7 may be effected either manually or mechanically; in the latter case, at least the rotating annular element 11 of the basing 8 shall be provided with teeth for engagement with at least two pinions positioned so as to have one of the pinions always engaged with the teeth of element 11 and obviate the presence of the diametral opening of the anular element.

What is claimed is:

1. An automatic fabric-spreading carriage, reciprocally displaceable on a bedplate and comprising at least one turret support rotating about a vertical axis, the carriage carrying a bolt of fabric to be unfolded when the axis of the bolt is oriented transversely with respect to the bedplate and to the direction of displacement of the carriage, characterized in that said turret support is rotatingly resting, by means of a foot step basing, on a pair of horizontal cross members attached to said carriage; said cross members defining therebetween on said turret support a vertical opening perpendicular to and beneath said bolt of fabric and oriented transversely with respect to said bedplate; said foot step basing having a passing diametral opening that positions itself in correspondence with said vertical opening when said turret support is in readiness for spreading said fabric on said bedplate, said fabric thus passing through said foot step basing.

2. The carriage according to claim 1, wherein said turret support comprises a framing rotating about said vertical axis; and wherein said foot step basing consists of a first and a second annular elements, complementary to each other; said first annular element being fixedly mounted on said cross members of said carriage; said second annular element being rotatingly attached to said framing; said first annular element having a diametral aperture in correspondence with said vertical opening between said cross members; said second annular element having a diametral aperture that places itself in correspondence with said diametral aperture of said first annular element and in correspondence with said vertical opening, so as to allow the passage of said fabric when said bolt-carrying turret support is in readiness for spreading said fabric.

3. The carriage according to claim 2, wherein said first and second annular elements are coupled by means of interposed rolling means and thus permit the rotation of said framing when a manual or mechanical rotational force is applied; said framing having a pair of cross members defining a mouth for guiding said fabric toward said diametral apertures.

* * * * *